United States Patent [19]

Arndt et al.

[11] Patent Number: 4,572,625

[45] Date of Patent: Feb. 25, 1986

[54] OPTICAL SYSTEM FOR A SIGHTING DEVICE

[75] Inventors: Klaus Arndt, Mägenwil; Saverio Sanvido, Glattbrugg, both of Switzerland

[73] Assignee: Contraves AG, Zürich, Switzerland

[21] Appl. No.: 606,399

[22] Filed: May 2, 1984

[30] Foreign Application Priority Data

May 17, 1983 [CH] Switzerland ..... 2677/83

[51] Int. Cl.[4] ..... G02B 23/04; G02B 23/08

[52] U.S. Cl. ..... 350/541; 350/540; 350/569

[58] Field of Search ..... 350/500, 538–544, 350/569, 571, 321; 356/7

[56] References Cited

U.S. PATENT DOCUMENTS 3,761,714 9/1973 Fernandez et al. ..... 350/500

4,386,848 6/1983 Clendenin et al. ..... 350/254

*Primary Examiner*—William H. Punter

*Attorney, Agent, or Firm*—Werner W. Kleeman

[57] ABSTRACT

An optical system for a periscope-like sighting device is proposed for the localization, tracking and measurement of a target and comprises a plurality of optical elements as well as a laser range-finder essentially comprising transmitter and receiver portions. In this optical system, the visible and invisible radiation mutually parallelly incident upon a main mirror rotatable about a first axis and pivotable about a second axis is reflected to a first deflection prism. The first deflection prism deflects the radiation at substantially right angles through an objective lens to a first beam-splitter. The first beam-splitter deflects the invisible laser radiation to the receiver portion and transmits the visible radiation to a second beam-splitter and thence to a second deflection prism and an ocular. For achieving a view of the field of observation or a tracking of the target, or both, a television camera can be arranged on the side of the housing of the sighting device.

14 Claims, 2 Drawing Figures

OPTICAL SYSTEM FOR A SIGHTING DEVICE

CROSS REFERENCE TO A RELATED APPLICATION

This application is related to our commonly assigned, copending U.S. application Ser. No. 06/606,398, filed May 2, 1984, and entitled "Periscope-Like Sighting Device".

BACKGROUND OF THE INVENTION

The present invention broadly relates to sighting devices, and, more specifically, pertains to a new and improved construction of an optical system for a periscope-like sighting device.

Generally speaking, the optical system of the present invention is intended for use in a periscope-like sighting device for the localization, tracking and measurement of a target and has a laser range-finder essentially comprising a transmitter portion and a receiver portion.

SUMMARY OF THE INVENTION

Therefore, with the foregoing in mind, it is a primary object of the present invention to provide a new and improved construction of an optical system for a sighting device which does not have associated with it the drawbacks and shortcomings of prior art constructions.

Another and more specific object of the present invention aims at providing a new and improved construction of an optical system for a sighting device of the previously mentioned type which is as cheap and simple as possible to design and construct without having an inverting or rectifying prism while enabling the integration of a laser range-finder and maintaining a high degree of measurement accuracy.

Yet a further specific object of the present invention aims at providing a new and improved construction of an optical system for a sighting device of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the optical system of the present invention is manifested by the features that the principal optical elements of the laser receiver portion are integrated into the optical system and that the optical system comprising individual or discrete elements or components is constructed such that visible and invisible radiation substantially parallelly incident upon a reflecting surface of a main mirror is conducted from the main mirror to a first deflection prism and thence substantially perpendicularly deflected through an objective lens or lens system to a first beam-splitter, the main mirror being rotatable about a first axis and pivotable about a second axis, the invisible radiation of the laser range-finder being deflected by the first beam-splitter and transmitted to the laser receiver portion and the visible radiation passing through and being conducted by a second beam-splitter to a second deflection prism and thence to an ocular.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
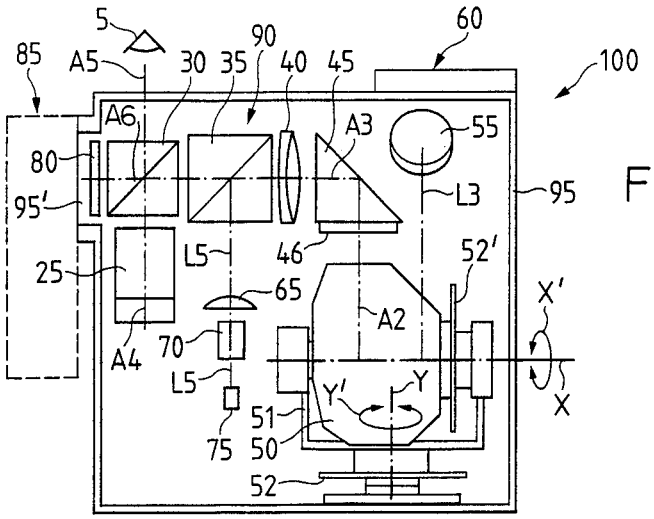
FIG. 1 schematically shows a sighting device with the optical system arranged in a housing.

Describing now the drawings, it is to be understood that to simplify the showing of the drawings only enough of the structure of the optical system for a sighting device has been illustrated therein as is needed to enable one skilled in the art to readily understand the underlying principles and concepts of this invention. The illustrated exemplary embodiment of the optical system will be seen to comprise a sighting device schematically represented in FIG. 1 and designated with the reference numeral 100. The sighting device essentially comprises a housing 95, an optical system 90 arranged therewithin as well as a laser range-finder 60 only partially represented in FIG. 1. The optical system 90 depicted in FIGS. 1 and 2 processer rays or beams A1, A2, A3, A4, A5 and A6 of visible radiation and is constructed as a first functional unit and the laser range-finder 60 is associated with rays or beams L1, L2, L3, L4 and L5 of invisible radiation and is constructed as a second functional unit.

Figure 2:
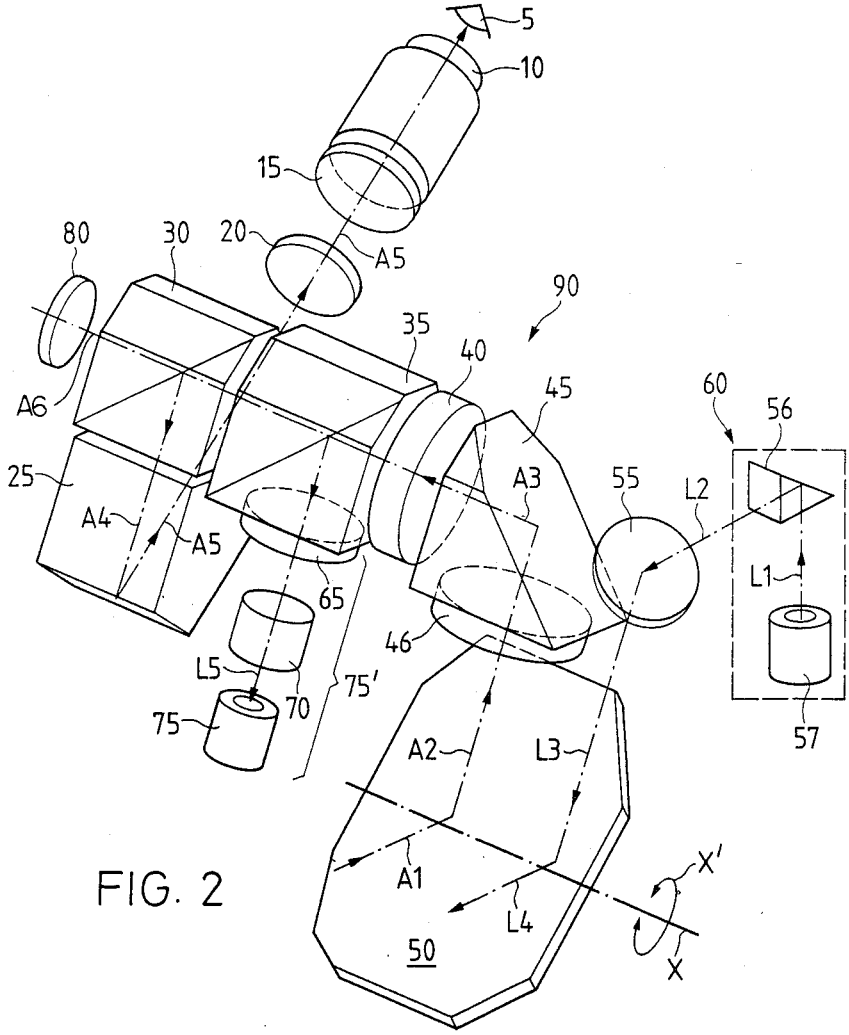
FIG. 2 is a schematic perspective view of the optical system of FIG. 1 on an enlarged scale.

The optical system 90 illustrated in perspective view and on an enlarged scale in FIG. 2 comprises, as seen in the direction of the A1, A2, A3, A4, A5 and A6 of visible radiation essentially a main mirror 50, a first deflection prism 45, a objective lens or lens system 40, a first beam-splitter 35, a second beam-splitter 30, a second deflection prism 25, a reticule or graduated disk 15 as well as an ocular or eyepiece 10 offering the eye 5 of an observer a view into the sighting device 100.

It will further be seen from FIG. 2, as seen in the direction of the rays or beams L1, L2, L3, L4 and L5 of invisible radiation, that the laser range-finder 60 is correspondingly associated with a deflection mirror 55 and essentially provided with a laser-transmitter portion 57 and a deflection prism 56. In the direction of the ray or beam A3 of visible radiation, a laser receiver portion 75' is arranged in spaced relationship to the deflection mirror 55 in the region of the first beam-splitter 35. The laser receiver portion 75' substantially comprises two optical elements 65 and 70 as well as the receiver 75 itself. The element 65 is a lens and the element 70 is a further objective lens or lens system constructed as a pin-hole aperture or optical diaphragm.

As seen in the direction of the ray or beam A5 which constitutes a visual observation ray or beam, a first laser blocking filter 20 is arranged between the second deflection prism 25 and the ocular or eyepiece 10. In order to achieve a monitoring view of the field of observation or a tracking of the target, or both, a television camera 85 can be arranged on the side of the housing 95 so as to receive the ray or beam A6 which constitutes a tracking ray or beam of visible radiation. An opening or aperture 95' provided in the housing 95 for the connection of the television camera 85 is closed off with a not particularly shown cover plate if such television camera is not installed. A second laser blocking filter 80 is arranged in the region of the opening or aperture 95'. Both laser blocking filters 20 and 80 serve to absorb residual laser rays or beams.

The components 50, 45, 40, 35, 30, 25 and 80 associated with the optical system 90 as well as the components 65, 70 and 75 associated with the laser range-finder 60 are, as shown in FIG. 1, arranged in the housing 95 of the sighting device 100 and retained by any suitable means not particularly shown. A suitable fixing device or retainer for the ocular or eyepiece 10 and the blocking filter 20 as well as the laser range-finder 60 itself are arranged on the rear side of the housing 95.

According to FIG. 1, the main mirror 50 is journaled in a schematically represented bearing body 51 to be pivotable about an elevation axis X in the direction of the arrow X', while the bearing body 51 is rotatable conjointly with the main mirror 50 about an azimuth axis Y in the direction of the arrow Y'. A first code disk 52 is provided for monitoring the rotary motion oriented in the direction of the arrow Y' and a second code disk 52' is provided for monitoring the pivoting motion oriented in the direction of the arrow X'. The main mirror 50 is provided with a conventional surface-coated reflecting glass disk or plate receiving and reflecting the rays or beams of visible and invisible radiation.

The first deflection prism 45 following and appropriately associated with the main mirror 50 is constructed to receive the beams of visible and invisible radiation reflected by the main mirror 50 and to deflect the beams of visible and invisible radiation through an angle of substantially 90° and comprises an aperture diaphragm or shield 46 on the lower side oriented toward the main mirror 50. The aperture diaphragm 46 is mounted on the deflection prism 45 and serves to limit the diameter of the radiation beam in the visual range.

The objective lens or lens system 40 arranged between the first deflection prism 45 and the first beam-splitter 35 is constructed as a two-lens achromatic system and conducts the beams of visible and invisible radiation deflected by the first deflection prism 45 to the first beam-splitter 35.

The first beam-splitter 35 splits or deflects the the ray or beam D5 of the invisible or laser radiation out of the optical path through the lens 65 and the further objective lens or lens system 70 to the receiver portion 75. The components 65 and 70 serve for afocally transmitting the ray or beam L5 of the invisible or laser radiation into the receiver 75.

The second beam-splitter 30 follows the first beam-splitter 35 and serves for deflecting the ray or beam of visible radiation or visual observation beam onto the second deflection prism 25, which is provided with a rear surface mirror coating, which generates the visual observation beam A5.

The ocular or eyepiece 10 serves for the observation and enlargement of the image field of observation conjointly with the reticule image and the reticule or graduated disk 15.

The beam-splitting obtainable with the second beam-splitter 30 also generates the tracking beam A6 of visible radiation and thus enables the use of the previously mentioned television camera 85 in addition to visual observation.

The method of observation by means of the sighting device 100 with the optical system 90 according to the invention will be described in more detail in the following:

Initially, an orientation or aiming process in which, for instance, a not particularly shown weapon upon which the sighting device 100 is mounted is oriented or aimed in elevation and azimuth at an object or target, is carried out by means of the sighting device 100. The image of the object or target arrives at the main mirror 50 as a ray or beam A1 of visible radiation and is, independent of the angular orientation or position of the main mirror 50, reflected as a ray or beam A2, limited or restricted in diameter by the aperture diaphragm 46, to the first deflection prism 45. It is then deflected by the latter through an angle of substantially 90° and transmitted through the objective lens or lens system 40 and the first beam-splitter 35 to the second beam-splitter 30 as a ray or beam A3 and thence as a visual observation ray or beam A4 to the second deflection prism 25. From the second deflection prism 25, the visual observation ray or beam A5 is conducted through the first blocking filter 20 to the ocular or eyepiece 10 and thus to the eye 5 of an observer.

When additionally performing measurement by means of the laser range-finder 60, the ray or beam L1 of invisible radiation transmitted by the laser transmitter portion 57 is conducted by the deflection prism 56 as a ray or beam L2 of invisible radiation through a not particularly shown aperture or opening of the housing 95 to the deflection mirror 55 and thence, axially parallel to the ray or beam A2 of visible radiation, as a ray or beam L3 of invisible radiation to the main mirror 55 and thence as a ray of visible radiation or beam L4 to the object or target. The not particularly shown or designated laser ray or beam reflected back from the object or target is reincident upon the main mirror 50 and travels parallel to and largely common with the rays or beams A1, A2 and A3 of visible radiation up to the first beam-splitter 35. The invisible or laser ray or beam is deflected by the first beam-splitter 35 and conducted through the lens 65 and the objective lens or lens system 70 as a ray or ray L5 of invisible radiation to the receiver portion 75.

Radiation transmitted to the television camera 85 can be employed to monitor the image or view the field of observation and to track a moving target.

While there are shown and described present preferred embodiments of the invention, it is to be distinctly understood that the invention is not limited thereto, but may be otherwise variously embodied and practiced within the scope of the following claims. Accordingly,

What we claim is:

1. An optical system for a periscope-like sighting device for localizing, tracking and measuring a target, comprising:

a laser range-finder comprising a transmitter portion and a receiver portion respectively transmitting and receiving a beam of invisible radiation;

said laser receiver portion of said laser range-finder having principal optical components integrated into the optical system;

the optical system comprising:

a main mirror containing a reflecting surface receiving and reflecting said beam of invisible radiation transmitted by said transmitter portion of said laser range finder and also receiving and reflecting a beam of visible radiation containing an image of said target;

said main mirror being rotatable about a first axis and pivotable about a second axis;

said main mirror receiving and reflecting said beams of visible and invisible radiation which are substantially parallelly incident upon said reflecting surface of said main mirror;

a first deflection prism following said main mirror and deflecting said beams of visible and invisible radiation reflected by said main mirror toward said first deflection prism;

an objective lens system;

a first beam-splitter;

said objective lens system being arranged between said first deflection prism and said first beam-splitter and conducting said beams of visible and invisible radiation deflected by said first deflection prism to said first beam-splitter;

said first beam-splitter splitting said beams of visible and invisible radiation received from said objective lens system into a beam of visible radiation and a beam of invisible radiation;

said first beam-splitter directing said beam of invisible radiation to said laser receiver portion of said laser range finder;

a second beam-splitter following said first beam-splitter and receiving said beam of visible radiation from said first beam-splitter;

an ocular; and said second beam-splitter splitting said beam of visible radiation received from said first beam-splitter into a visual observation beam directed toward said ocular and a tracking beam.

2. The optical system as defined in claim 1, further including:

a deflection mirror operatively associated with said main mirror;

said deflection mirror conducting the invisible radiation transmitted by the transmitter portion of the laser range-finder to the main mirror and thence to a target; and the deflection mirror conducting such radiation substantially axially parallel with the visible radiation reflected by the main mirror.

3. The optical system as defined in claim 1, further including:

a television camera for achieving a monitoring of the image and receiving said tracking beam generated by said second beam-splitter; and said monitoring of the image being performed in addition to observation and target measurements by means of the visible and invisible radiation.

4. The optical system as defined in claim 1, further including:

a television camera for achieving a target-tracking and receiving said tracking beam generated by said second beam-splitter; and said target-tracking being performed in addition to observation and target measurements by means of the visible and invisible radiation.

5. The optical system as defined in claim 1, further including:

a television camera for achieving a monitoring of the image and a tracking of the target and receiving said tracking beam generated by said second beam-splitter; and said monitoring of the image and tracking of the target being performed in addition to observation and target measurements achieved with the visible and invisible radiation.

6. A multiple-element optical system for a periscope-like sighting device for the localization, tracking and measurement of a target, comprising:

a laser range-finder essentially including a laser transmitter portion and a laser receiver portion;

a main mirror having a first axis and a second axis;

said main mirror being rotatable about said first axis and pivotable about said second axis and having a reflecting surface;

a first deflection prism;

a second deflection prism;

an objective lens means;

a first beam-splitter;

a second beam-splitter;

an ocular;

said laser transmitter portion of said laser range-finder transmitting a beam of invisible radiation to said reflecting surface of the main mirror;

said transmitted beam of invisible radiation being incident upon the reflecting surface of the main mirror substantially parallel to a beam of visible radiation which emanates from the target, and being transmitted toward the target;

a beam of invisible radiation reflected from the target and said beam of visible radiation being conducted from the reflecting surface of the main mirror to said first deflection prism and thence through said objective lens means to said first beam-splitter;

the first deflection prism deflecting the beam of invisible radiation reflected from the target and the beam of visible radiation substantially through a right angle;

said first beam-splitter splitting said beams of invisible and visible radiation and deflecting the beam of invisible radiation reflected from the target to the laser receiver portion;

the first beam-splitter transmitting the beam of visible radiation to said second beam-splitter; and said second beam-splitter splitting said beam of visible radiation transmitted from said first beam-splitter into a visual observation beam directed to said ocular and a tracking beam.

7. The optical system as defined in claim 6, further including:

a deflection mirror operatively associated with said main mirror;

said deflection mirror conducting said transmitted beam of invisible radiation from said laser transmitter portion to the main mirror and thence to the target; and the deflection mirror conducting the transmitted beam of invisible radiation substantially axially parallel with said beam of visible radiation incident upon said reflecting surface of the main mirror and emanating from said target.

8. The optical system as defined in claim 6, further including:

a television camera for viewing the image independently of visual and laser observation;

a housing accommodating said laser range finder, said main mirror, said first deflection prism, said second deflection prism, said objective lens means, said first beam-splitter, said second beam-splitter, and said ocular; and said television camera being removably mounted at said housing and receiving said tracking beam generated by said second beam-splitter.

9. The optical system as defined in claim 6, further including:

a television camera for tracking the target independently of visual and laser observation;

a housing accommodating said laser range finder, said main mirror, said first deflection prism, said second deflectin prism, said objective lens means, said first beam-splitter, said second beam-splitter, and said ocular; and said television camera being removably mounted at said housing and receiving said tracking beam generated by said second beam-splitter.

10. The optical system as defined in claim 6, further including:

a television camera for viewing the image and for tracking the target independently of visual and laser observation;

a housing accommodating said laser range finder, said main mirror, said first deflection prism, said second deflection prism, said objective lens means, said first beam-splitter, said second beam-splitter, and said ocular; and said television camera being removably mounted at said housing and receiving said tracking beam generated by said second beam-splitter.

11. The optical system as defined in claim 1, wherein:

said first deflection prism following said main mirror deflects said beams of visible and invisible radiation through an angle of substantially 90°.

12. The optical system as defined in claim 6, wherein:

said first deflection prism following said main mirror deflects said beams of visible and invisible radiation through an angle of substantially 90°.

13. The optical system as defined in claim 2, wherein:

said laser receiver portion is arranged in a spaced relationship to the deflection mirror which conducts the invisible radiation from said laser transmitter portion of said laser range finder to said main mirror, in a direction substantially parallel to the beams of visible and invisible radiation which are conducted from said first deflection prism by said objective lens system to said first beam-splitter, and in the region of said first beam-splitter.

14. The optical system as defined in claim 7, wherein:

said laser receiver portion is arranged in a spaced relationship to the deflection mirror which conducts the invisible radiation from said laser transmitter portion of said laser range finder to said main mirror, in a direction substantially parallel to the beams of visible and invisible radiation which are conducted from said first deflection prism by said objective lens system to said first beam-splitter, and in the region of said first beam-splitter.

* * * * *

UNITED STATES PATENT AND TRADEMARK OFFICE

CERTIFICATE OF CORRECTION

PATENT NO. : 4,572,625

DATED : February 25, 1986

INVENTOR(S) : KLAUS ARNDT et al

It is certified that error appears in the above—identified patent and that said Letters Patent is hereby corrected as shown below:

Column 2, line 27, please delete "processer" before "rays" and insert --processes--

Column 2,line 34, before "A1" please insert --rays or beams--

Column 2, line 37, before "objective" please delete "a" and replace it with --an--

Column 3, line 43, after "deflects" please delete "the" (first occurrence)

Column 3, line 52, after "beam" please insert --A4--

Column 4, line 30, after "ray" please delete "of visible radiation"

Column 4, line 39, before "L5" please delete "ray" and replace it with --beam--

Column 7, line 7, before "prism" please delete "deflectin" and replace it with --deflection--

UNITED STATES PATENT AND TRADEMARK OFFICE

CERTIFICATE OF CORRECTION

PATENT NO. : 4,572,625

DATED : February 25, 1986

INVENTOR(S) : KLAUS ARNDT et al

It is certified that error appears in the above-identified patent and that said Letters Patent is hereby corrected as shown below:

Column 3, line 44, after "beam" please delete "D5" and replace it with --L5--.

Signed and Sealed this

Second Day of December, 1986

*Attest:*

DONALD J. QUIGG

*Attesting Officer*

*Commissioner of Patents and Trademarks*